US006041439A

United States Patent [19]

Yamanaka

[11] Patent Number: 6,041,439

[45] Date of Patent: Mar. 28, 2000

[54] SIZE ADJUSTABLE HAT WITH ZIGZAG STITCHING FORMING DRAWSTRING TUBE

[76] Inventor: Katsushige Yamanaka, 4-7-1, Kitakokubun, Ichikawa-shi, Chiba, Japan

[21] Appl. No.: 08/907,439

[22] Filed: Aug. 8, 1997

[30] Foreign Application Priority Data

| | | | |
|---|---|---|---|
| Aug. 26, 1996 | [JP] | Japan | 8-242638 |
| Oct. 25, 1996 | [JP] | Japan | 8-299873 |
| May 8, 1997 | [JP] | Japan | 9-132956 |

[51] Int. Cl.[7] ..... A42B 1/22

[52] U.S. Cl. ..... 2/183; 2/175.1

[58] Field of Search ..... 2/183, 175.1, 184, 2/195.2, 417, 418

[56] References Cited

U.S. PATENT DOCUMENTS

| | | | |
|---|---|---|---|
| 1,992,285 | 2/1935 | Blum | 2/183 |
| 2,194,043 | 3/1940 | Jacobi | 2/183 |

*Primary Examiner*—Diana Oleksa
*Attorney, Agent, or Firm*—McGlew and Tuttle, P.C.

[57] ABSTRACT

A size adjustable hat, wherein a bag shaped portion is formed all around the circumference 2 of an extremity of a crown section 1 positioned inside said crown section, or a central hole peripheral portion 3 of a brim, or a slider base portion or a slider cuffed portion 14*a* into a bag shaped portion 4,5, or by affixing a tubular portion 7 on these portions or providing an independent tubular portion between these portions, and by introducing a size adjustment drawstring 6 into this bag shaped portion or tubular portion, and by drawing the both ends of this drawstring for shrinking these cuffed portions of the crown section or the hole peripheral portion of the brim positioned inside the hat.

6 Claims, 2 Drawing Sheets

SIZE ADJUSTABLE HAT WITH ZIGZAG STITCHING FORMING DRAWSTRING TUBE

FIELD OF THE INVENTION

The present invention relates to a hat wherein its size can be adjusted according to the head size of the wearer when he/she puts it on.

BACKGROUND OF THE INVENTION

Concerning a hat size adjusting method, conventionally, it has been proposed to notch the rear portion of the crown section and to bridge this notched portion with a length adjuster for adjusting the size by extending or retracting the adjuster, or to pile up rear portions to adjust.

Moreover, as in case of swimming cap or the like, it has been proposed to insert a drawstring all around the lower circumference of the crown section and to draw the both ends of this drawstring for adjusting the diameter of the cap.

In such conventional method, as the diameter of the bottom part of the crown section is adjusted, wrinkles occur around the head on the hat bottom part so as to deteriorate not only the appearance but also the silhouette.

Moreover, particularly in ladies' hats, models are numerous in their color, shape and material and, additionally, they vary with the seasons, and their total number will become an awesome figure. Practically, it is impossible to prepare different sizes for their respective model. As the consequence, only one size of 57 cm is actually provided. So, the users of hats of the other size are extremely inconvenienced.

Furthermore, in hats manufacturing, at least 6 part masters are necessary as pattern master and finishing master for one hat model; as a consequence, when a number of models are to be manufactured, thus the cost will increase as much.

SUMMARY AND OBJECTS OF THE INVENTION

Therefore, the present invention intends to provide a size adjustable hat which would not wrinkle around the outer circumference and deteriorate the silhouette when the size thereof is adjusted by a drawstring.

For this sake, it is resolved by forming a size adjusting section inside the hat.

Namely, the inner diameter of a hat can be adjusted smaller without affecting the hat outside face by forming an inner cuffed portion of a hat crown section, or a central hole peripheral portion of a brim, or a slider base portion or a slider cuffed portion into a bag shaped portion, or by affixing a tubular portion on these portions or providing an independent tubular portion between these portions, and by introducing a size adjustment drawstring into this bag shaped portion or tubular portion, and by drawing the both ends of this drawstring for shrinking these cuffed portions of the crown section or the hole peripheral portion of the brim positioned inside the hat.

DESCRIPTION OF THE PREFERRED EMBODIMENTS

A tubular portion is affixed all around a cuffed portion at the extremity of a crown section positioned inside the crown section, or a central hole peripheral portion of a brim positioned inside the crown section, or a slider base portion or a slider cuffed portion and a size adjustment drawstring is introduced into this tubular portion. As the consequence, for adjusting the hat inner diameter, the diameter of the cuffed portion of the crown section or the hole peripheral portion of the brim portion can be made smaller by drawing the both ends of this drawstring and thus the hat size can be modified. At this moment, as the diameter modification is realized inclined toward the hat center in the cuffed portion or the central hole peripheral portion, this modification will not affect the hat outside, the shape modification being limited to the hat inside.

Not only drawstring but also belt or other well-known adjuster may be employed for adjusting the size.

Note that the tubular portion can be partially disposed with a convenient interval around the inner circumference of a hat, in place of disposing all around the hat. The tubular portion can be cross-stitched with string or cord, or formed into a net.

Moreover, in place of affixing a tubular portion, a cuffed portion of a hat crown section, or a central hole peripheral portion of a brim themselves can be formed into a bag shape, introducing a drawstring into this bag shaped portion.

The appearance of the size adjustable hat according to the present invention is excellent, because any hat size can be easily defined by drawing both ends of a drawstring introduced into a tube or bag shaped portion and, without affecting the hat exterior or silhouette. This will prevent the retailer or distributor from preparing various sizes, contributing advantageously to the product management and the finance.

In the manufacturing also, only one model of rather large size has been prepared, and in response to the order, provided as the finished product by adjusting the size with a drawstring. This advantage will make the stock control easier and save from preparing masters for different size, so the cost can be reduced and, moreover, immediately hats of different sizes can be shipped in response to the order.

EXAMPLE 1

Figure 1:
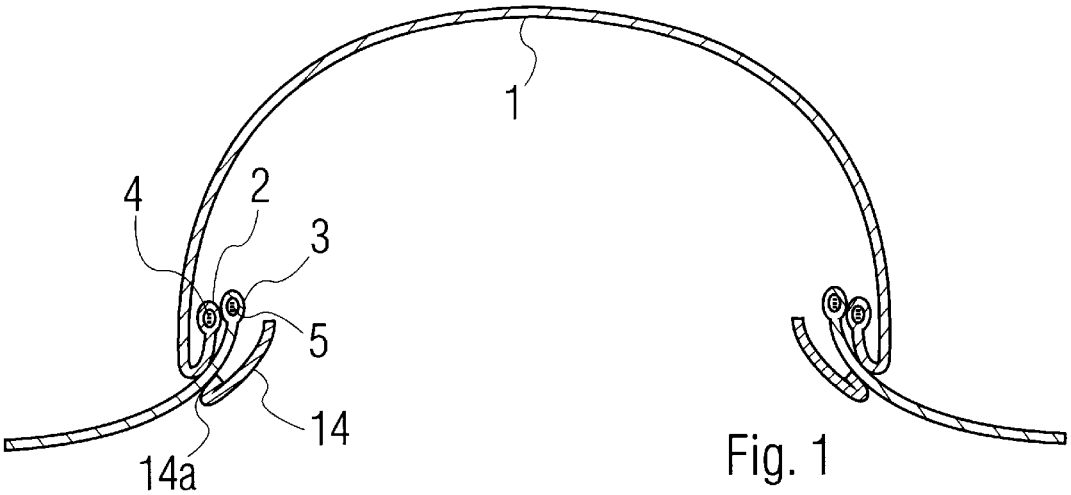
FIG. 1 is a cross section of a first embodiment wherein a bag section is formed.

As shown in FIG. 1, an inside cuffed portion 2 at the extremity of a hat crown section 1 is formed into a tubular portion or bag shaped portion 4, all around the circumference thereof and a size adjustment drawstring 6 is introduced into this bag shaped portion.

This bag shaped portion 5 may also be formed on a hole peripheral section 3 of a brim stitched with a part being folded inward from the cuffed portion 2 of the crown section. Note that the reference number 14 indicates a slider with a base portion 14*a*.

EXAMPLE 2

Figure 2:
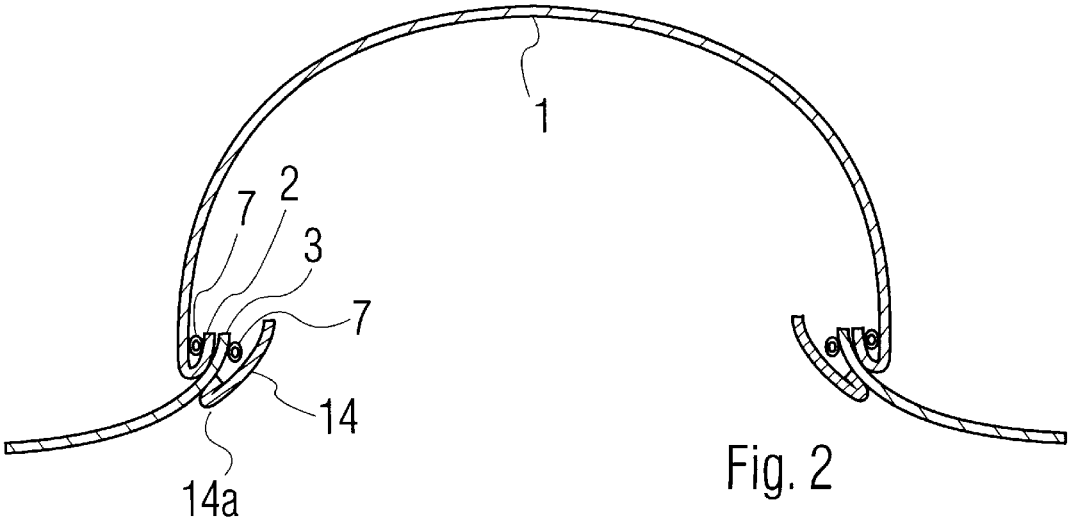
FIG. 2 is a cross section of a second embodiment wherein a tubular portion is formed.

As shown in FIG. 2, a tubular portion 7 is affixed all around the cuffed portion 2 to the inside at the extremity of the crown section and a size adjustment drawstring is introduced into this tube.

This tubular portion 4,5 can also be provided partially with a convenient interval in place of all around the circumference.

Moreover, the tubular portion may be affixed to the central hole peripheral portion 3 of the brim in place of the cuffed portion 2.

The cuffed portion may also be formed at the base portion of a slider 14 or the slider itself and the tube may be affixed to that cuffed portion and, moreover, it may also be disposed respectively between the cuffed portion 2 of the crown section and, the central hole peripheral portion 3 or the slider.

EXAMPLE 3

Figure 3:
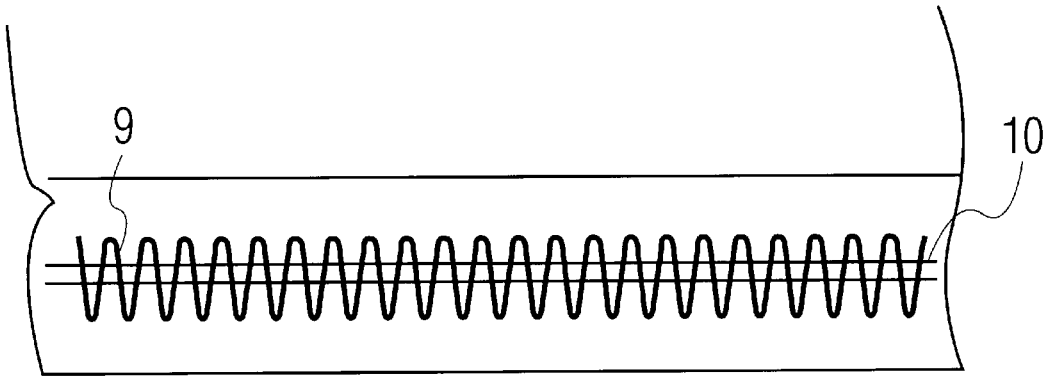
FIG. 3 is a view showing a variation of the tubular portion.

FIG. 3 is an enlarged view of a tubular portion of an embodiment.

In this case, the tubular portion is zigzag-stitched with a string 9 or a cord and a size adjustment drawstring 10 therethrough is introduced.

EXAMPLE 4

Figure 4:
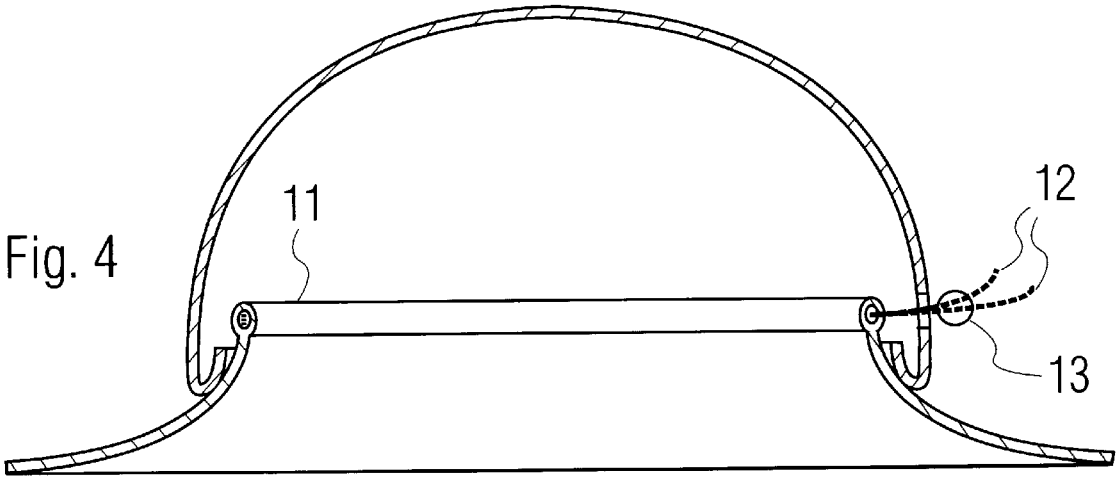
FIG. 4 is a cross section of an embodiment wherein a size adjusting drawstring is drawn out.

FIG. 4 shows another embodiment.

Both ends of a size adjustment drawstring 12 to be introduced into the tubular portion or bag section 11 have been pulled out of the crown section. 13 represents a binding device of the drawstring.

I claim:

1. A size adjustable hat, comprising:

a hat crown section;

a brim connected to said hat crown section;

a tubular portion formed by a thread zig-zag stitch or thread net structure with threads stitched directly into one of said hat crown section and said brim; and a size adjustment drawstring with two ends, said thread zig-zag stitch or thread net structure, with threads stitched directly into said one of said hat crown section and said brim, cooperating with said one of said hat crown section and said brim to define a tubular space with a portion of said drawstring disposed in said tubular space of said tubular portion so as to allow the hat inner diameter to be adjusted by drawing both ends of said drawstring.

2. The size adjustable hat according to claim 1, wherein said tubular portion is connected to said crown section and both ends of said size adjustment drawstring extend out of said crown section.

3. A size adjustable hat, comprising:

a hat crown section;

a brim connected to said hat crown section;

a slider connected to one of said brim and said hat crown section;

a tubular portion formed by a thread zig-zag stitch or thread net structure with threads stitched directly into one of said hat crown section, said slider and said brim; and a size adjustment drawstring with two ends, said thread zig-zag stitch or thread net structure, with threads stitched directly into said one of said hat crown section, said slider and said brim, cooperating with said one of said hat crown section, said slider and said brim to define a tubular space with a portion of said drawstring disposed in said tubular space of said tubular portion so as to allow the hat inner diameter to be adjusted by drawing both ends of said drawstring.

4. The size adjustable hat according to claim 3, wherein said tubular portion is connected to said crown section and both ends of said size adjustment drawstring extend out of said crown section.

5. A size adjustable hat, comprising:

a hat crown section;

a tubular portion formed by a thread zig-zag stitch or thread net structure with threads sewn directly into said hat crown section; and a size adjustment drawstring with two ends, said thread zig-zag stitch or thread net structure with threads stitched directly into said hat crown section cooperating with said crown section to define a tubular space with a portion of said drawstring disposed in said tubular space of said tubular portion so as to allow the hat inner diameter to be adjusted by drawing both ends of said drawstring.

6. The size adjustable hat according to claim 5, wherein both ends of said size adjustment drawstring extend out of said crown section.

* * * * *